US006433467B1

(12) United States Patent
Lee et al.

(10) Patent No.: US 6,433,467 B1
(45) Date of Patent: Aug. 13, 2002

(54) SHADOW MASK FOR CATHODE RAY TUBE

(75) Inventors: Kwang-Sik Lee, Seongnam-si; Do-Hun Phun, Yongin-si; Dong-Hwan Kim; Tae-Hoon Kweon, both of Kyungki-do; Jung-Soo Chang, Ulsan, all of (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 09/497,825

(22) Filed: Feb. 3, 2000

(30) Foreign Application Priority Data

Feb. 10, 1999 (KR) ..... 99-4664
Jan. 14, 2000 (KR) ..... 00-1679

(51) Int. Cl.[7] ..... H01J 29/80
(52) U.S. Cl. ..... 313/402; 313/407
(58) Field of Search ..... 313/402, 404, 313/407, 408

(56) References Cited

U.S. PATENT DOCUMENTS 4,072,876 A * 2/1978 Morrell ..... 313/403
4,280,077 A * 7/1981 Villanyi ..... 313/402
5,384,511 A * 1/1995 Fujimura ..... 313/402

* cited by examiner

*Primary Examiner*—Michael D. Day
*Assistant Examiner*—Mack Haynes
(74) *Attorney, Agent, or Firm*—Christie, Parker & Hale, LLP

(57) ABSTRACT

A shadow mask for a cathode ray tube having a faceplate panel with an inner phosphor screen includes a front surface and a side wall. The front surface is formed with a beam-guide portion having a plurality of apertures, and a non-opening portion surrounding the beam-guide portion. The side wall is bent from the non-opening portion at an angle, and fixed to the panel via a mask frame. The front surface of the shadow mask has a predetermined waved pattern in at least one direction.

18 Claims, 8 Drawing Sheets

SHADOW MASK FOR CATHODE RAY TUBE

FIELD OF THE INVENTION

The present invention relates to a shadow mask for a cathode ray tube (CRT) and, more particularly, to a shadow mask which has a sufficient degree of structural strength.

DESCRIPTION OF THE RELATED ART

Generally, CRTs are provided with a color selection shadow mask for ensuring the correct landing of electron beams on a phosphor screen.

FIG. 12 is a cross sectional view of a CRT with a shadow mask according to a prior art, and FIG. 13 is a perspective view of the shadow mask shown in FIG. 12.

As shown in FIG. 12, the CRT includes a faceplate panel 3 with an inner phosphor screen 1, and a funnel 5 and a neck 7 sequentially connected to the panel 3. An electron gun 9 is fitted within the neck 7 to emit R, G and B electron beams. A shadow mask 11 is mounted within the panel 3 while facing the phosphor screen 1 at a close distance. The shadow mask 11 is fixed to the panel 3 by interposing a mask frame 13. The shadow mask 11 has a plurality of beam-guide apertures 11*a* that make it possible for each of the R, G and B electron beams to strike only its intended phosphor on the phosphor screen 1.

As shown in FIG. 13, the shadow mask 11 is formed with a beam-guide portion 11*b* where the aforementioned apertures 11*a* are placed, a non-opening portion surrounding the beam-guide portion 11*b*, and a side wall 11*c* bent from the non-opening portion at an angle. The side wall 11*c* of the shadow mask 11 is welded to the mask frame 13 such that the beam-guide portion 11*b* faces the phosphor screen 1 at a close distance. The distance between the beam-guide portion 11*b* of the shadow mask 11 and the phosphor screen 1 is usually called the "Q value".

In order to constantly maintain the Q value, the beam-guide portion 11*b* of the shadow mask 11 is curved with a curvature radius corresponding to that of the internal surface of the panel 3 where the phosphor screen 1 is formed. In this connection, as the panel 3 becomes flatter and flatter, the curvature radius of the effective screen portion 11*b* should be increased as much,.

When the curvature radius of the beam-guide portion 11*b* increases to a large extent, its mechanical strength is seriously deteriorated. Furthermore, considering that the shadow mask 11 is formed with an extremely thin metal plate where numerous apertures 11*a* are located, the beam-guide portion 11*b* of the shadow mask 11 exhibits extremely weak structural strength.

In the above structure, the beam-guide portion 11*b* of the shadow mask 11 is liable to suffer deformation even at minimum degrees of vibration or shock. In this case, the apertures 11*a* formed at the beam-guide portion 11*b* deviate from their proper positions so that the electron beams cannot strike correct phosphors on the phosphor screen 1, and this deviation results in poor picture images.

SUMMARY OF THE INVENTION

It is an object of the present invention to provide a shadow mask for a CRT which has a sufficient degree of structural strength, and produces good picture images.

This and other objects may be achieved by a shadow mask for a CRT having a faceplate panel with an inner phosphor screen. The shadow mask includes a front surface and a side wall. The front surface is formed with a beam-guide portion having a plurality of apertures, and a non-opening portion surrounding the beam-guide portion. The side wall is bent from the non-opening portion at an angle, and fixed to the panel via a mask frame. The front surface of the shadow mask has a predetermined waved pattern in at least one direction.

The predetermined wave pattern of the front surface is structured to satisfy the following condition:

$$-0.03 < \frac{\Delta Q}{Q} < +0.03$$

where Q indicates the average distance between the front surface and the phosphor screen, and ΔQ indicates the difference between the actual distance of the aperture of the shadow mask to the phosphor screen and the average distance between the front surface and the phosphor screen.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components.

DETAILED DESCRIPTION OF THE PREFERRED EMBODIMENTS

Preferred embodiments of this invention will be explained with reference to the accompanying drawings.

Figure 1:
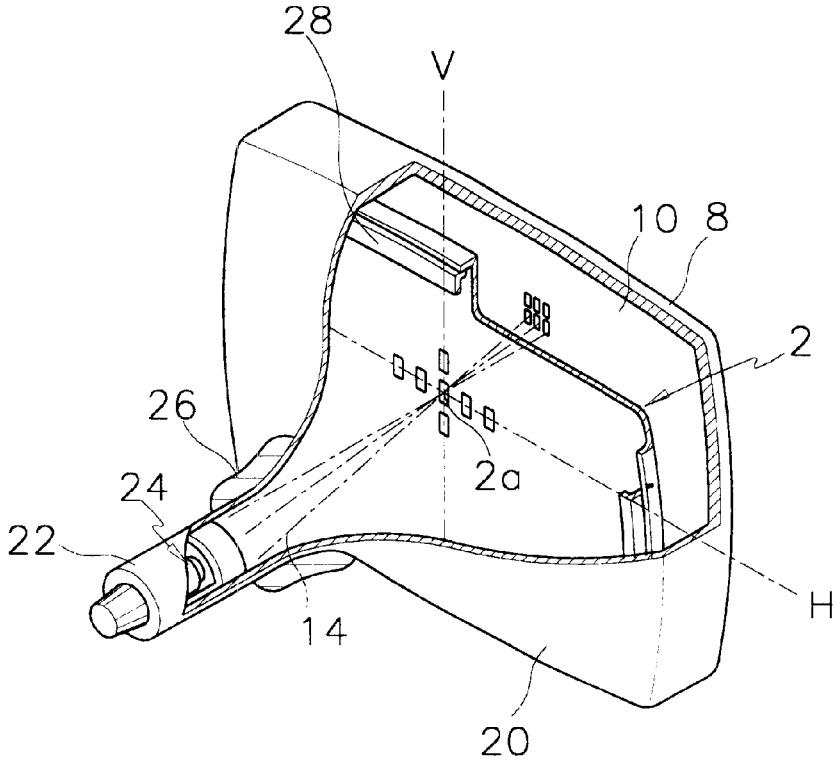
FIG. 1 is a partial sectional perspective view of a CRT with a faceplate panel and a shadow mask according to a first preferred embodiment of the present invention.

FIG. 1 is a partial sectional perspective view of a CRT with a shadow mask 2 according to a first preferred embodiment of the present invention. The CRT includes a faceplate panel 8 with a phosphor screen 10, and a funnel 20 and a neck 22 sequentially connected to the panel 8 at the rear of the phosphor screen 10.

An electron gun 24 is fitted within the neck 22 to produce R, G and B electron beams 14, and a deflection yoke 26 is mounted around the funnel 20 to horizontally and vertically deflect the electron beams 14.

The color selection shadow mask 2 is mounted within the panel 8 by using a mask frame 28 as a support.

Figure 2:
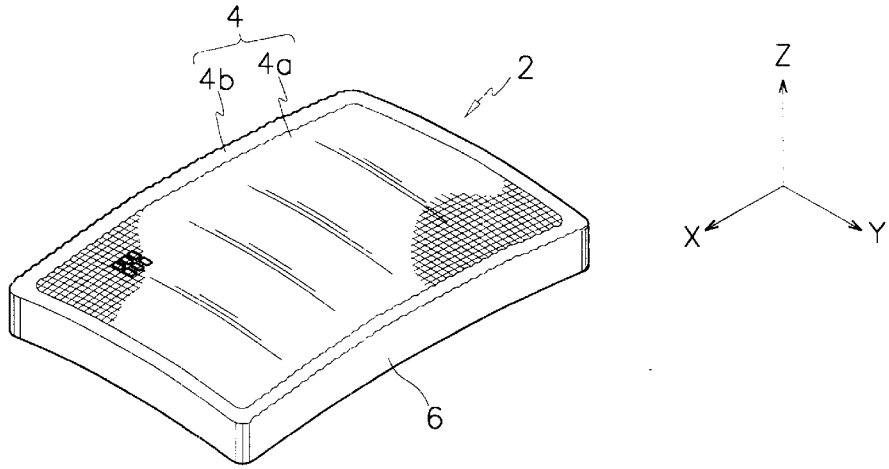
FIG. 2 is a perspective view of the shadow mask shown in FIG. 1.
Figure 3:
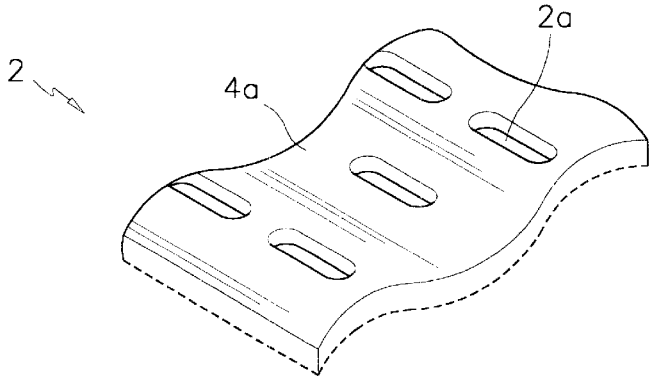
FIG. 3 is a partial amplified perspective view of the shadow mask shown in FIG. 1.

FIG. 2 is a perspective view of the shadow mask 2, and FIG. 3 is a partial amplified view of the shadow mask 2. The shadow mask 2 has a front surface 4 facing the phosphor screen 10 of the panel 8, and a side wall 6 bent from the front surface 4 at an angle. The front surface 4 of the shadow mask 2 is substantially rectangular-shaped with long opposite sides in the horizontal direction X, short opposite sides in the vertical direction Y, and four corners in the diagonal direction.

The front surface 4 of the shadow mask 2 is formed with a beam-guide portion 4*a* having a plurality of apertures 2*a* for selectively passing the R, G and B electron beams 14, and a non-opening portion 4*b* surrounding the beam-guide portion 4*a*. The side wall 6 of the shadow mask 2 is welded to the mask frame 28.

The front surface 4 of the shadow mask 2 is processed to make a predetermined wave pattern from one of the short sides to the other short side such that the cross section along the horizontal direction X takes on a sinusoidal shape. It is also possible to make the wave pattern in any other direction.

In comparison with usual non-processed shadow masks, the surface-processed shadow mask 2 bears improved structural strength.

Figure 4:
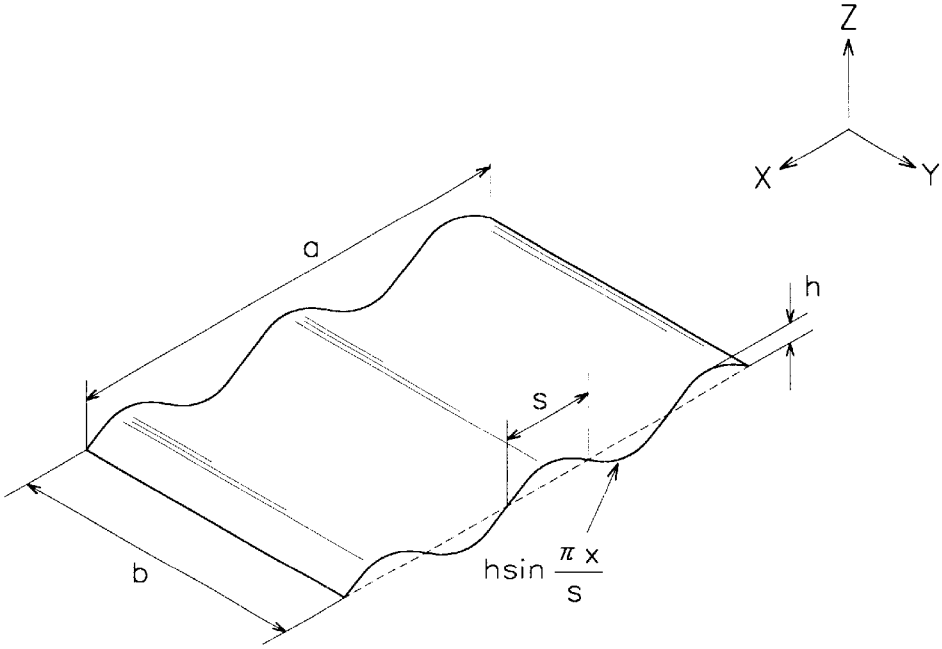
FIG. 4 is a schematic view of a wave-patterned plate for forming the shadow mask shown in FIG. 1.

Advantages of the shadow mask 2 with the wave-patterned front surface 4 will be now explained with reference to FIG. 4. In the drawing, a wave-patterned plate with a horizontal length a, a vertical length b and a thickness t is schematically illustrated. The plate is assumed to be constantly under a predetermined load p(x,y), and the wave pattern of the plate is characterized by a sine wave with a wavelength 2*s* and an amplitude 2*h*. Under the assumptions, the flexural rigidity of the plate in the horizontal and vertical directions $D_x$ and $D_y$ can be expressed by the mathematical formulas 101 and 102, respectively, and $D_{xy}$ by mathematical formula 103.

$$D_x = \frac{s}{\lambda}\frac{Et^3}{12(1-v^2)}, \tag{101}$$

where v indicates the Poisson ratio in the wave-patterned plate, E indicates the coefficient of elasticity of the plate, s indicates the half-wavelength of the wave patterned at the plate, and λ is expressed by mathematical formula 105.

$$D_y = EI, \tag{102}$$

where I indicates the moment of inertia of the plate.

$$D_{xy} = 0. \tag{103}$$

The moment of inertia I can be expressed by mathematical formula 104.

$$I = 0.5\ h^2 t\left(1 - \frac{0.81}{1 + 2.5\left(\frac{h}{2s}\right)^2}\right). \tag{104}$$

$$\lambda = s\left(1 + \frac{\pi^2 h^2}{4s^2}\right). \tag{105}$$

The load p(x,y) working on the plate can be expressed by mathematical formula 106.

$$P(x, y) = D_x\frac{\partial^4 w}{\partial x^4} + 2H\frac{\partial^4 w}{\partial x^2 \partial y^2} + D_y\frac{\partial^4 w}{\partial y^4} \tag{106}$$

The weight of deflection w(x,y) of the plate can be expressed by mathematical formula 107.

$$w(x, y) = \frac{4}{ab}\sum_{a=1}^{\infty}\sum_{n=1}^{\infty}\int_0^b\int_0^a \frac{p(x, y)\sin(m_x x/a)\sin(n_x y/b)dxdy}{(m^4x^4/a^4)D_x + 2H(m^2n^2x^4/a^2b^2) + (n^4x^4/b^4)D_y} \times \sin\left(\frac{m_x x}{a}\right)\sin\left(\frac{n_x y}{b}\right), \tag{107}$$

where H is in turn expressed by mathematical formula 108.

$$H = D_{xy} + 2G_{xy} = \frac{\lambda}{a}\frac{Et^3}{12(1+v^2)}. \tag{108}$$

where $G_{xy}$ indicates the torsion rigidity of the plate.

As the flexural rigidities $D_x$ and $D_y$ are proportional to the wavelength 2*s* and the amplitude 2*h* of the sine wave, the rigidities of the wave-patterned plate increase, whereas the weight of deflection thereof decreases. In consideration of the structural stability of the plate, it is preferred that the wavelength 2*s* of the sine wave is larger than the amplitude 2*h*. Furthermore, since the flexural rigidity and the torsion rigidity are harmonized as indicated in mathematical formula 108, the plate has a sufficient strength for enduring against external shock or impact.

As evidenced above, the shadow mask 2 with such a sine wave-patterned front surface 4 can bear better strength compared to the conventional non-processed shadow masks.

Meanwhile, in the above-structured front surface 4 of the shadow mask 2, as the apertures 2*a* of the beam-guide portion 4*a* are not at a same distance from the phosphor screen 10, the electron beams 14 are liable to deviate from their intended trajectories and strike incorrect phosphors on the phosphor screen 10.

Accordingly, the wave peak of the front surface 4 of the shadow mask 2 should be so defined as to prevent the electron beams from striking incorrect phosphors.

In order to establish the appropriate wave peak range of the front surface 4 of the shadow mask 2, the so-called electron beam sigma σ characteristic should be considered.

Figure 5:
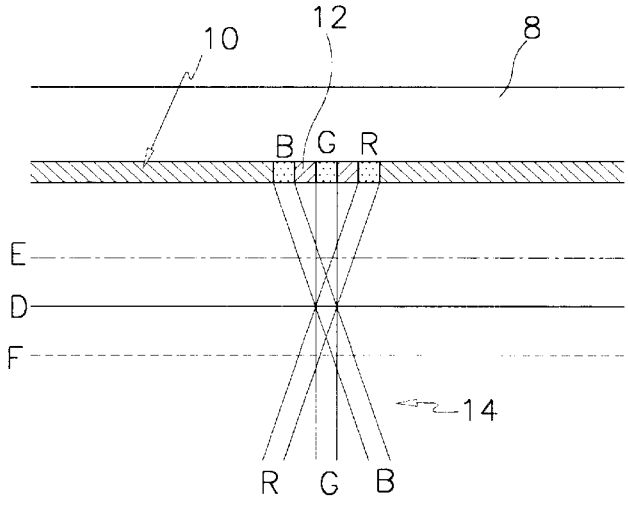
FIG. 5 is a schematic view illustrating a general positional relation of the shadow mask shown in FIG. 1 to the panel.

FIG. 5 is a schematic view illustrating the general positional relation of the phosphor screen 10 of the panel 8 to the front surface 4 of the shadow mask 2. The R, G and B phosphors are spaced apart from one another by interposing a black matrix 12. The electron beam sigma σ layout controls the distance between the neighboring phosphors such that it is the same as that between the corresponding electron beams 14 landing on the phosphor screen 10 so that the electron beams 14 can strike the correct phosphors.

The electron beam sigma σ is similar to the concept of a standard deviation. When the electron beam sigma σ is 1, the distance between the neighboring phosphors is established to be substantially the same as that between the corresponding electron beams 14. In such a case, it may be assumed that the front surface 4 of the shadow mask 2 is positioned at the D line shown in FIG. 5.

When the front surface 4 of the shadow mask 2 moves from the D line to the E line such that it becomes closer to the panel 8, the distance between the R and B electron beams becomes narrower while centering around the G electron beam. This phenomenon is called "grouping" where the electron beam sigma σ is less than 1.

In contrast, when the front surface 4 of the shadow mask 2 moves from the D line to the F line such that it becomes far away from the panel 8, the distance between the R and B electron beams becomes wider while centering around the G beam. This phenomenon is called "degrouping" where the electron beam sigma σ is greater than 1.

When either grouping or degrouping occurs due to variation in the so-called Q values, the electron beams 14 landing on the phosphor screen 10 strike incorrect phosphors so that the desired screen image cannot be obtained.

In this connection, the range of the electron beam sigma σ for obtaining correct landing of the electron beams 14 on the phosphor screen 10 can be expressed by mathematical formula 109.

$$0.97<\sigma<1.03. \tag{109}$$

Figure 6:
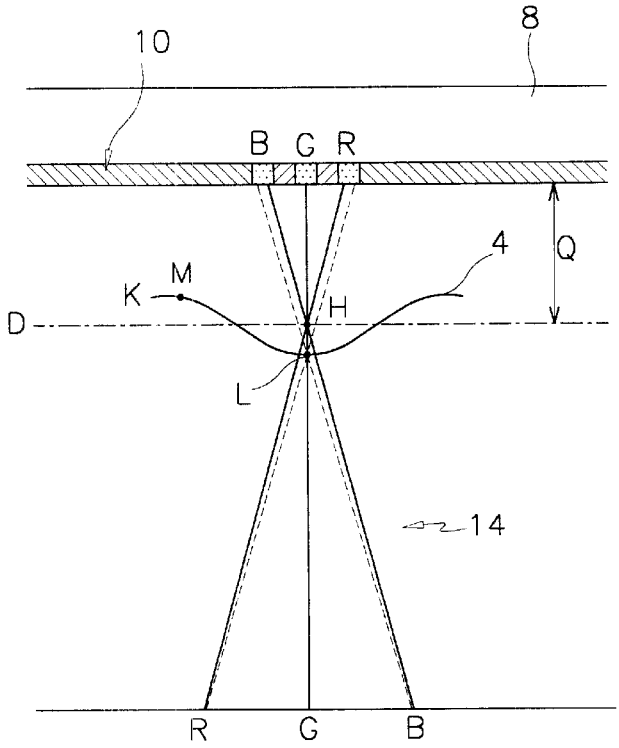
FIG. 6 is a schematic view illustrating a specific positional relation of the shadow mask shown in FIG. 1 to the panel.
Figure 7:
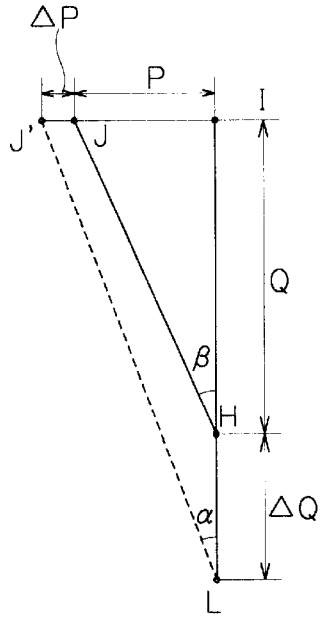
FIG. 7 is a schematic view illustrating a more specific positional relation of the shadow mask shown in FIG. 1 to the panel.

FIG. 6 illustrates the specific positional relation of the front surface 4 of the shadow mask 2 to the phosphor screen 10 of the panel 8, and FIG. 7 illustrates such a relation more specifically.

As shown in the drawings, when the electron beam sigma σ is 1, it may be assumed that the principal position of the front surface 4 of the shadow mask 2 is posed at the D line, and a particular aperture of the beam-guide portion 4*a* placed on the D line is positioned at the H point. It is further assumed that the G electron beam passed through the H point lands on the I point of the phosphor screen 10. And an R or B electron beam passed through the H point is supposed to land on the J point of the phosphor screen 10. In this case, the distance between the H point and the I point may be indicated by Q, and the distance between the I point and the J point by P.

The predetermined wave pattern of the front surface 4 of the shadow mask 2 is outlined by the K line, and a particular peak on the K line is assumed to be the L point.

As shown in FIG. 7, when the front surface 4 of the shadow mask 2 becomes far away from the panel 8, degrouping occurs so that the distance between the neighboring electron beams 14 becomes wider and, hence, the B electron beam passed through the L point lands on the J' point.

In case the distance between the H point and the L point is indicated by ΔQ, and the distance between the J point and the J' point by ΔP, the mathematical formulas 110 and 111 can be deduced.

$$\tan\alpha = \frac{P+\Delta P}{Q+\Delta Q}. \tag{110}$$

$$\tan\beta = \frac{P}{Q}. \tag{111}$$

where α is the angle between a line drawn through the L and I points and a line drawn through L and J' points and β is the angle between a line drawn through the H and I points and a line drawn through the H and J points.

As the relation α>β is derived from the mathematical formulas 110 and 111, the mathematical formula 112 can be obtained.

$$\frac{P+\Delta P}{Q+\Delta Q} < \frac{P}{Q}. \tag{112}$$

When the electron beam sigma under degrouping at the peak point L is indicated by σ', it can be expressed by the mathematical formula 113.

$$\sigma' = 1 + \frac{\Delta P}{P} \tag{113}$$

The maintenance of the optimum electron beam sigma σ means that the electron beam sigma σ' at the peak point L should be kept within the range of 0.97–1.03 as in the mathematical formula 109. Thus, the mathematical formula 113 can be rewritten by the mathematical formula 114.

$$-0.03 < \frac{\Delta P}{P} < +0.03 \tag{114}$$

Mathematical formula 115 can be derived from the mathematical formula 112.

$$\frac{\Delta P}{P} < \frac{\Delta Q}{Q}. \tag{115}$$

Consequently, it follows that ΔQ/Q should be kept within the range specified in the mathematical formula 114 and, hence, the mathematical formula 116 can be obtained.

$$-0.03 < \frac{\Delta Q}{Q} < +0.03 \tag{116}$$

where Q indicates the distance between the front surface 4 of the shadow mask 2 and the phosphor screen 10 of the panel 8 when the electron beam sigma σ is 1, and ΔQ indicates the positional variation of the front surface 4 of the shadow mask 2 due to the wave patterning. In other words, Q indicates the average distance between the front surface 4 and the phosphor screen 10, and ΔQ indicates the difference between the actual distance of the apertures 2*a* to the phosphor screen 10 and the average distance.

When the front surface 4 of the shadow mask 2 becomes far away from the panel 8 such that it is placed at the L point shown in FIG. 7, the value of ΔQ/Q turns out to be positive. In contrast, when the front surface 4 of the shadow mask 2 becomes closer to the panel 8 such that it. is placed at the M point, the value of ΔQ/Q turns out to be negative.

Accordingly, the shadow mask 20 should be structured to satisfy the mathematical formula 116 so that neither grouping nor degrouping due to the wave patterning occurs. In such a structure, the R, G and B electron beams 14 all strike the correct phosphors on the phosphor screen 10, thereby producing the desired screen image.

In the following preferred embodiments of the present invention, other components of the shadow mask 2 are the same as those related to the first preferred embodiment except that the direction or position of the wave patterning with respect to the front surface 4 of the shadow mask 2 is made in a different manner.

Figure 8:
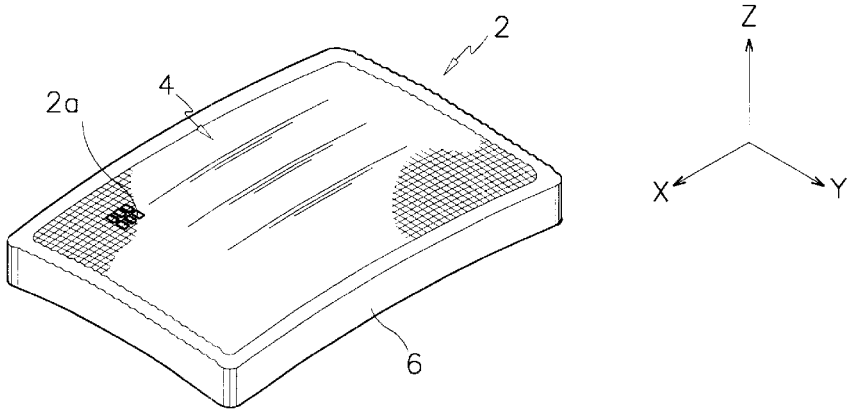
FIG. 8 is a perspective view of a shadow mask according to a second preferred embodiment of the present invention.

FIG. 8 is a perspective view of a shadow mask according to a second preferred embodiment of the present invention. As shown in FIG. 8, the wave pattern of the front surface 4 of the shadow mask 2 is formed from one of the long sides toward the other long side such that the cross section along the vertical direction Y takes on a sinusoidal shape.

Figure 9:
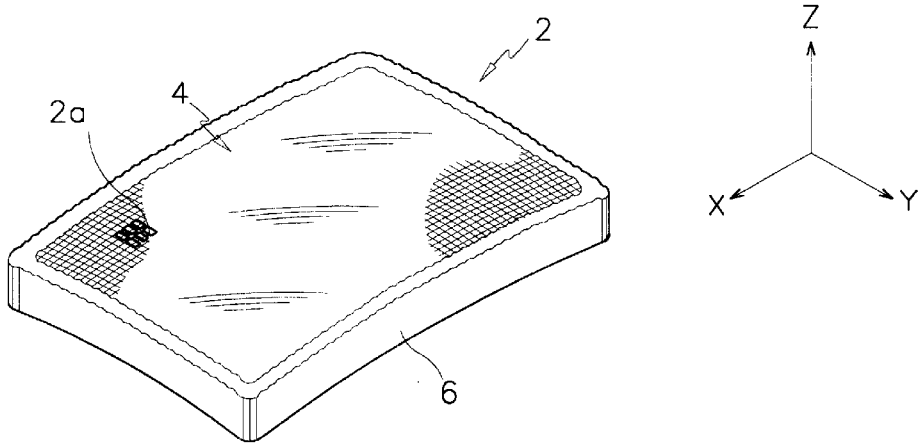
FIG. 9 is a perspective view of a shadow mask according to a third preferred embodiment of the present invention.

FIG. 9 is a perspective view of a shadow mask according to a third preferred embodiment of the present invention. As shown in FIG. 9, the wave pattern of the front surface 4 of the shadow mask 2 is formed from one of the corners toward the opposite corner such that the cross section along the diagonal direction takes on a sinusoidal shape.

Figure 10:
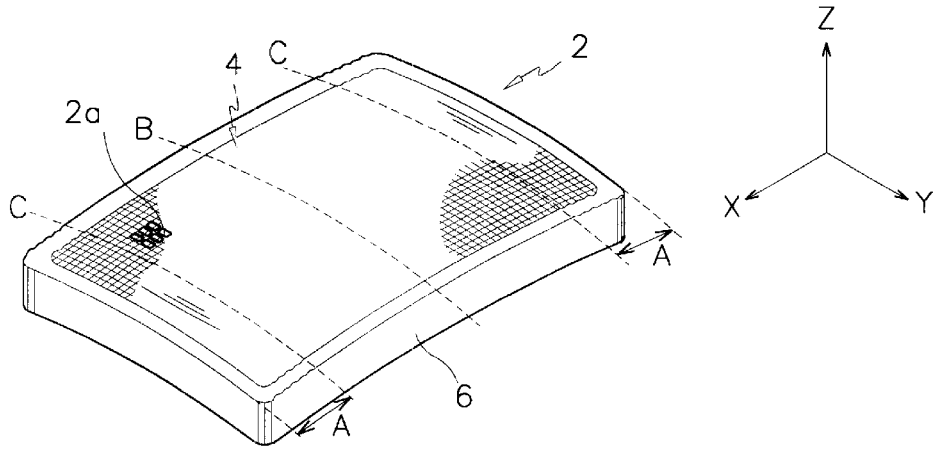
FIG. 10 is a perspective view of a shadow mask according to a fourth preferred embodiment of the present invention.

FIG. 10 is a perspective view of a shadow mask according to a fourth preferred embodiment of the present invention. As shown in FIG. 10, the wave pattern is formed only at left and right end portions of the front surface 4 of the shadow mask 2.

Specifically, when it is assumed that a center line B is drawn on the front surface 4 of the shadow mask 2 in the vertical Y direction, and left and right side lines C are each drawn in the vertical Y direction at a distance from the its respective short side one sixth of the way along the long side, the wave pattern is formed in the area A that ranges from the left side line C to the left short side and from the right side line C to the right short side.

Considering that the landing of the electron beams becomes poor at the side end area A even at minute varying in Q values, the above structure makes it possible to positively inhibit variation in the Q values at such an area.

Figure 11:
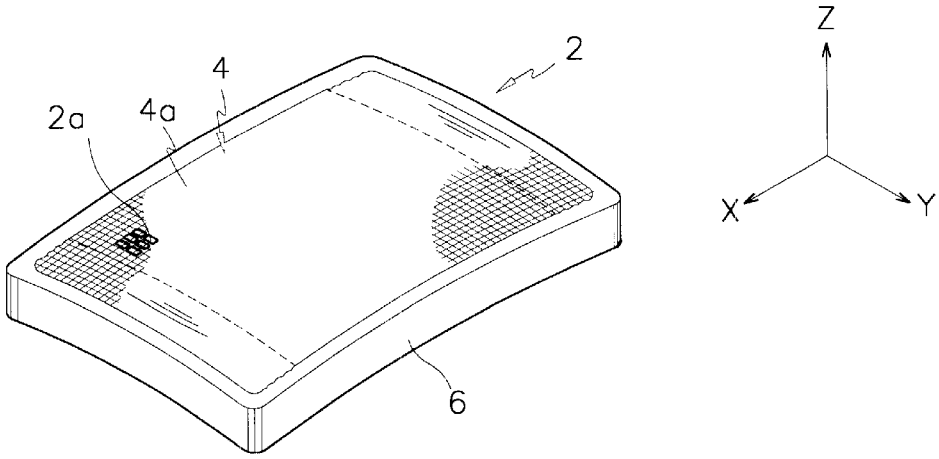
FIG. 11 is a perspective view of a shadow mask according to a fifth preferred embodiment of the present invention.
Figure 12:
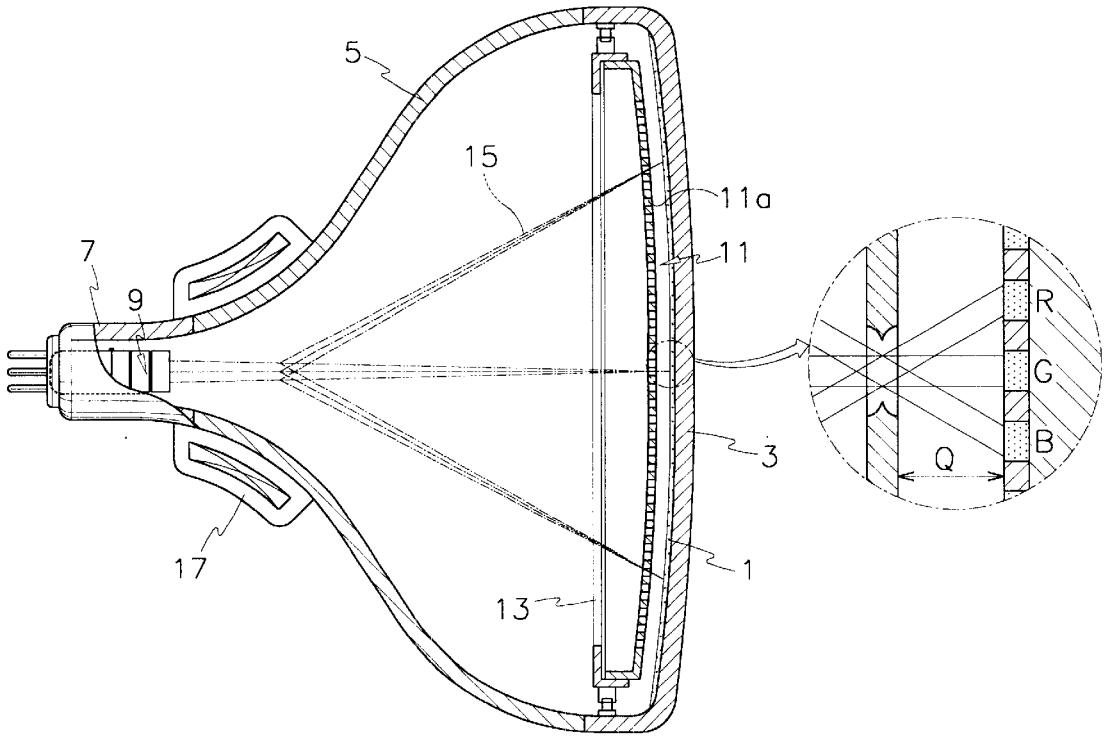
FIG.12(Prior Art)
FIG. 12 is a cross sectional view of a CRT with a shadow mask according to a prior art.
Figure 13:
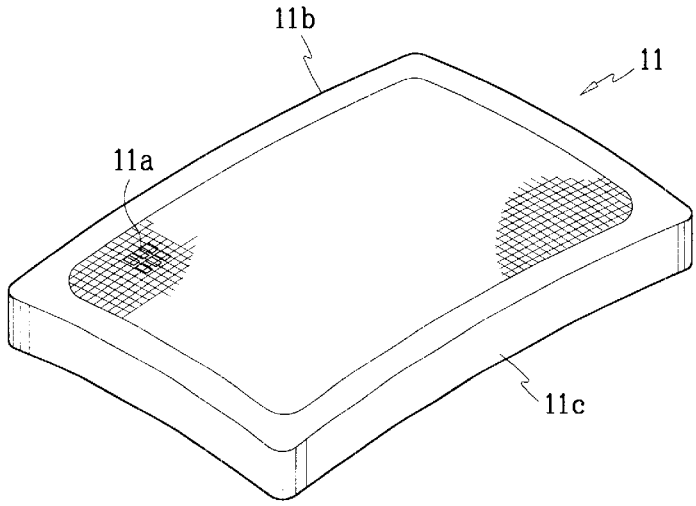
FIG.13(Prior Art)
FIG. 13 is a perspective view of the shadow mask shown in FIG. 12.

FIG. 11 is a perspective view of a shadow mask according to a fifth preferred embodiment of the present invention. In this preferred embodiment, as shown in FIG. 11, the direction or position of the wave patterning with respect to the front surface 4 of the shadow mask 2 is the same as that related to the fourth preferred embodiment except that the wave pattern is formed only at the beam-guide portion 4*a* of the shadow mask 2 where the apertures 2*a* are placed.

As described above, the wave-patterned shadow mask has a sufficient strength for enduring external shock or impact, and produces good picture images by establishing the wave patterning within the appropriate range.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A shadow mask for a cathode ray tube having a faceplate panel with an inner phosphor screen, the shadow mask comprising:

a front surface having a wave pattern in at least one direction, the front surface comprising a beam-guide portion having a plurality of apertures, and a non-opening portion surrounding the beam-guide portion, the front surface being substantially rectangular-shaped with opposite horizontal sides each having a horizontal length, opposite vertical sides each having a vertical length shorter than the horizontal length, and four corners one at each intersection of the horizontal and vertical sides, wherein the wave pattern of the front surface extends from one of the horizontal sides of the front surface toward the other horizontal side such that a cross section along a vertical direction comprises a sinusoidal shape; and a side wall bent from the front surface, the side wall being adapted for mounting to the faceplate panel via a mask frame.

2. The shadow mask of claim 1 wherein the wave pattern of the front surface extends from one of the corners of the front surface toward an opposing corner such that a cross section along a diagonal direction comprises a sinusoidal shape.

3. The shadow mask of claim 1 wherein the wave pattern extends alone an entire area of the front surface.

4. A shadow mask for a cathode ray tube having a faceplate panel with an inner phosphor screen, the shadow mask comprising:

a front surface having a wave pattern in at least one direction, the front surface comprising a beam-guide portion having a plurality of apertures, and a non-opening portion surrounding the beam-guide portion, the front surface being substantially rectangular-shaped with opposite horizontal sides each having a horizontal length, opposite vertical sides each having a vertical length. shorter than the horizontal length, and four corners one at each intersection of the horizontal and vertical sides, wherein the wave pattern is disposed only at opposite end portions of the front surface; and a side wall bent from the front surface, the side wall being adapted for mounting to the faceplate panel via a mask frame.

5. The shadow mask of claim 4 wherein the end portions of the front surface with the wave pattern each comprises one third of an area between a vertical center line bisecting the front surface and its respective vertical side of the front surface.

6. A shadow mask for a cathode ray tube having a faceplate panel with an inner phosphor screen, the shadow mask comprising:

a front surface having a wave pattern in at least one direction, the front surface comprising a beam-guide portion having a plurality of apertures, and a non-opening portion surrounding the beam-guide portion, the front surface being substantially rectangular-shaped with opposite horizontal sides each having a horizontal length, opposite vertical sides each having a vertical length shorter than the horizontal length, and four corners one at each intersection of the horizontal and vertical sides, wherein the wave pattern extends only along the beam-guide portion of the front surface; and a side wall bent from the front surface, the side wall being adapted for mounting to the faceplate panel via a mask frame.

7. A cathode ray tube, comprising:

a faceplate panel with an inner phosphor screen;

a shadow mask with a front surface, the front surface having a wave pattern in at least one direction, the front surface comprising a beam-guide portion having a plurality of apertures and a non-opening portion surrounding the beam-guide portion, the front surface being substantially. rectangular shaped with opposite horizontal sides each having a horizontal length, opposite vertical sides each having a vertical length shorter than the horizontal length, and four corners one at each intersection of the horizontal and vertical sides, wherein the wave pattern of the front surface is structured to satisfy the following condition:

$$-0.03 < \frac{\Delta Q}{Q} < +0.03$$

where Q indicates an average distance between the front surface and the phosphor screen, and ΔQ indicates a difference between an actual distance from the apertures of the shadow mask to the phosphor screen and the average distance from the front surface to the phosphor screen; and a mask frame connecting the shadow mask to the face-plate panel.

8. The shadow mask of claim 7 wherein the wave pattern of the surface extends from one of the sides along the first direction toward its opposing side such that a cross section along the second direction comprises a sinusoidal shape.

9. The shadow mask of claim 7 wherein the wave pattern of the surface extends from one of the sides along the second direction toward its opposing side such that a cross section along the first direction comprises a sinusoidal shape.

10. The shadow mask of claim 7 wherein the wave pattern of the surface extends from one of the corners of the surface toward an opposing corner such that a cross section along diagonal direction comprises a sinusoidal shape.

11. The shadow mask of claim 7 wherein the wave pattern extends along an entire area of the surface.

12. The shadow mask of claim 7 wherein the wave pattern extends only along opposite end portions of the surface.

13. The shadow mask of claim 12 wherein the wave pattern disposed at opposite end portions of the surface comprises one-third of an area of the surface, and wherein an area of the wave pattern at one end portion is about equal to an area of the wave pattern at the opposing end portion.

14. The shadow mask of claim 7 wherein the wave pattern extends only along the beam-guide portion of the surface.

15. A shadow mask comprising a surface having a wave pattern in at least one direction, wherein the surface comprises a substantially rectangular shape with a beam-guide portion having a plurality of apertures, and a non-opening portion surrounding the beam-guide portion, the shadow mask further comprising a side wall extending from the non-opening portion at an angle, wherein the surface comprises opposite sides along a first direction, opposite sides along a second direction perpendicular to the first direction, and four corners defined by the intersections of the sides, and wherein the wave pattern extends only along opposite end portions of the surface.

16. The shadow mask of claim 15 wherein the wave pattern disposed at opposite end portions of the surface comprises one-third of an area of the surface, and wherein an area of the wave pattern at one end portion is about equal to an area of the wave pattern at the opposing end portion.

17. A shadow mask comprising a surface having a wave pattern in at least one direction, wherein the surface comprises a substantially rectangular shape with a beam-guide portion having a plurality of apertures, and a non-opening portion surrounding the beam-guide portion, the shadow mask further comprising a side wall extending from the non-opening portion at an angle, wherein the surface comprises opposite sides along a first direction, opposite sides along a second direction perpendicular to the first direction, and four corner defined by the intersections of the sides, and wherein the wave pattern extends only along the beam-guide portion of the surface.

18. A shadow mask comprising a surface having a wave pattern in at least one direction, wherein the surface comprises a substantially rectangular shape with a beam-guide portion having a plurality of apertures; and a non-opening portion surrounding the beam-guide portion, the shadow mask further comprising a side wall extending from the non-opening portion at an angle, wherein the surface comprises opposite sides along a first direction, opposite sides along a second direction perpendicular to the first direction, and four corner defined by the intersections of the sides, and wherein the wave pattern of the surface is diagonally oriented extending in a diagonal direction from one of the corners of the surface toward a diagonally opposite corner of the surface such that a cross section along a diagonal direction comprises a sinusoidal shape.

* * * * *